US006073760A

United States Patent [19]

Roemer et al.

[11] Patent Number: 6,073,760

[45] Date of Patent: Jun. 13, 2000

[54] CORRUGATED FIBREBOARD CONTAINER WITH AT LEAST ONE HINGED SIDE AND BLANKS FOR ASSEMBLING SAID CONTAINER

[75] Inventors: Donald A. Roemer, Pace; Keith M. Williams, Pensacola; Stanley J. Gasi, Cantonment; Stephen S. Smith, Pensacola, all of Fla.

[73] Assignee: Champion International Corporation, Stamford, Conn.

[21] Appl. No.: 09/100,984

[22] Filed: Jun. 22, 1998

Related U.S. Application Data

[63] Continuation-in-part of application No. 08/880,667, Jun. 23, 1997.

[51] Int. Cl.[7] ..... B65D 85/00; B65D 5/32; B65D 43/08

[52] U.S. Cl. ..... 206/215; 206/555; 229/122; 229/125.19; 229/145

[58] Field of Search ..... 229/122, 145, 229/146, 125.08, 122.1, 930, 125.19; 206/449, 555, 215

[56] References Cited

U.S. PATENT DOCUMENTS

| | | | |
|---|---|---|---|
| 408,979 | 8/1889 | Jewell | 229/145 |
| 466,479 | 11/1892 | Winchester | 229/122 |
| 474,062 | 5/1892 | Hurd | 229/122 X |
| 1,058,929 | 4/1913 | Weiss | 229/125.08 |
| 1,847,694 | 3/1932 | Kondolf | 229/125.19 |
| 1,975,444 | 10/1934 | Block | 229/125.08 X |
| 2,180,691 | 11/1939 | Olivier | 229/122 X |
| 2,718,998 | 9/1955 | Bemiss | 229/930 X |
| 2,776,083 | 1/1957 | Derman | 229/122 |
| 3,441,193 | 4/1969 | Castle | 229/122 X |
| 4,512,477 | 4/1985 | Densen | 229/125.08 X |
| 4,753,348 | 6/1988 | Patrick et al. | 206/449 |
| 5,794,770 | 8/1998 | Plomgren et al. . | |

*Primary Examiner*—Bryon P. Gehman

[57] ABSTRACT

A corrugated fibreboard container is provided for packaging a stack of loose paper sheets which comprises a carton and a lid, both formed from two planar blanks. The carton is formed with four sides which define inner dimensions substantially coincident with the dimensions of the paper sheets to be stored therein, with one side being hingedly connected to the bottom of the carton which allows for rotation thereof and access to the stack of loose paper sheets from a point adjacent the hinged side. The container limits the exposure of moisture to the paper sheets stored therein with a moisture resistant coating being disposed on the inner surfaces thereof, special slots, and an adhesive tape being provided for ensuring a tight securement between the lid and the carton. In an alternative embodiment, the lid may be hingedly connected to the carton.

12 Claims, 5 Drawing Sheets

CORRUGATED FIBREBOARD CONTAINER WITH AT LEAST ONE HINGED SIDE AND BLANKS FOR ASSEMBLING SAID CONTAINER

This application is a continuation-in-part of U.S. application Ser. No. 08/880,667, filed Jun. 23, 1997, now pending.

BACKGROUND OF THE INVENTION

1. Field of the Invention

This invention relates to corrugated fibreboard containers, and, more particularly, to a corrugated fibreboard container for packaging loose paper sheets.

2. Description of the Prior Art

Corrugated fibreboard containers for accommodating loose paper sheets are well-known in the prior art. In the prior art, loose paper sheets are packaged in reams, each ream comprising 500 sheets, bound by ream wrap, with the ream bundles being, in turn, packaged in corrugated fibreboard cartons. Each ream bundle provides an individual with a pre-packaged stack of loose paper sheets which is easy to handle and transfer. However, large consumers of ream bundles, such as operators of high speed photocopying machines, generate a considerable amount of spent ream wrap, which must be disposed of. Additionally, light users of loose paper sheets must store any unused portion of an opened ream bundle.

Alternatively, the prior art includes corrugated fibreboard containers for packaging loose paper sheets directly therein. To prevent movement of the loose paper sheets within a prior art corrugated fibreboard container and minimizing damage to the fragile edges of the sheets, the side walls of the container are formed to substantially define the dimensions of the paper sheets packaged therein. It can be appreciated that the lack of clearance between the edges of the loose paper sheets and the side walls of the container make it difficult for an individual to remove the paper sheets from the container. Prior art corrugated fibreboard containers provide little or no space about the edges of the loose paper sheets into which an individual may slide his hands and easily grab a stack of paper sheets. The individual will often have to tilt or upturn the container and force the loose paper sheets to slide out therefrom in disarray, possibly resulting in folding or tearing of the edges of the sheets. Also, if the disordered paper sheets are intended for use in a photocopying machine, an operator of the photocopying machine will have to orderly stack the loose sheets, with all the edges of the sheets in alignment, so that the paper sheets can be properly loaded into the photocopying machine. Thus, there is a need for a packaging container for loose paper sheets which provides ample accessibility to the loose paper sheets stored therein, allows easy removal of the paper sheets packaged therein, and does not utilize ream wrap.

It is an object of the subject invention to provide a container which has ample accessibility to paper sheets packaged therein.

It is also an object of the subject invention to provide a container for packaging paper sheets which allows for the easy removal of the packaged paper sheets in an orderly stacked fashion.

Yet another object of the subject invention is to provide a container for packaging paper sheets without the use of any ream wrap which allows for the easy removal of the paper sheets therefrom in an orderly stacked fashion ready for an application, such as loading into a photocopying machine.

SUMMARY OF THE INVENTION

The above-stated objects are met by a corrugated fibreboard container preferably comprising a carton and a lid. The carton is generally parallelepiped shaped and formed from a corrugated fibreboard blank with a hinged side which gives access to paper sheets stored in the container from a point adjacent the hinged side. The lid may be provided for emplacement on the carton to protect the paper sheets stored therein and maintain the hinged side in a closed, upright position.

The carton is formed to accommodate a stack of single-sized paper sheets and includes a rectangular bottom having a perimeter dimensioned to substantially coincide with the edges of the paper sheets to be stored therein. Three rigid upstanding sides extend from the bottom, and, preferably, the fourth side is hingedly connected to the bottom through a fold line which allows rotation of the hinged side from a closed, upright position to an open, inclined position. With the hinged side being upright, the four sides form a constant rectangular cross-section, defining inner dimensions substantially coincident with the edges of the single-sized paper sheets. Flaps are provided along the vertical edges of the hinged side which are bent to extend inward into the carton. With the hinged side being in an upright position, the flaps frictionally engage the sides adjacent to the hinged side and maintain the hinged side in an upright or substantially upright position. An individual can obtain access to the stored paper sheets by simply rotating the hinged side downwardly and overcoming the frictional engagement between the flaps and the adjacent sides.

The lid comprises a downwardly depending edge defining a rectangular opening dimensioned to register with the top of the carton. With the lid emplaced on the carton, the downwardly depending edge overlaps a portion of each of the sides of the carton and provides support for maintaining the hinged side in an upright position. In the preferred embodiment, the downwardly depending edge is rigid and formed with a constant width throughout.

The container of the subject invention can be shipped with an adhesive tape securing the lid to the container. The tape extends about portions of the edge of the lid and the carton to ensure securement therebetween. Accordingly, access to the paper sheets stored in the container of the subject invention is readily provided by forcibly removing the lid from the carton by removing or cutting the tape, and rotating downwardly the hinged side of the carton. In this manner, access is provided to one entire side of the stack of paper sheets stored in the carton, and an individual may easily remove a portion of the stack while maintaining the sheets in an orderly stacked fashion.

The adhesive tape serves to restrict the amount of moisture the packaged paper sheets are exposed to by maintaining tight securement between the lid and the carton. In addition, the flaps extending from the hinged side are each provided with planar base edge portions which are placed in face-to-face engagement with the bottom of the carton in an assembled state. Likewise, the side opposite the hinged side has flaps which are each formed with planar base edge portions which are also placed in face-to-face engagement with the bottom of the carton. The various face-to-face engagements of the planar base edge portions and the bottom of the carton limit the ingress of moisture into the assembled carton. Also, a moisture resistant coating may be provided on the inner surfaces of the lid and the carton to further limit the introduction of moisture into the corrugated fibreboard container of the subject invention. To comply with recycling laws, a repulpable polymeric coating, such as VAPORCOAT 2200™ manufactured by Michelman, Inc. or similar product, may be used to form the moisture resistant coating. Alternatively, a fully repulpable and recyclable laminated liner, such as FIBER-LAM POLYCORR™ liner, sold by Fiber-Lam, Inc., may be used. Upon removal of the adhesive tape, the container of the subject invention may be comprised of fully recyclable materials.

In an alternative embodiment the lid can be hingedly secured to the carton. Preferably, a portion of the edge of the lid is rigidly secured to the side of the carton which is opposite the hinged side. With this arrangement, in practice, the lid can be rotated upwardly about the rigid connection to completely expose the hinged side of the carton and allow the hinged side to be rotated downwardly to provide access to paper stored in the carton. With this embodiment, misplacement and/or damage to the lid can be obviated.

These and other features of the invention will be better understood through a study of the following detailed description of the invention in the accompanying drawings.

DETAILED DESCRIPTION OF THE INVENTION

Figure 1:
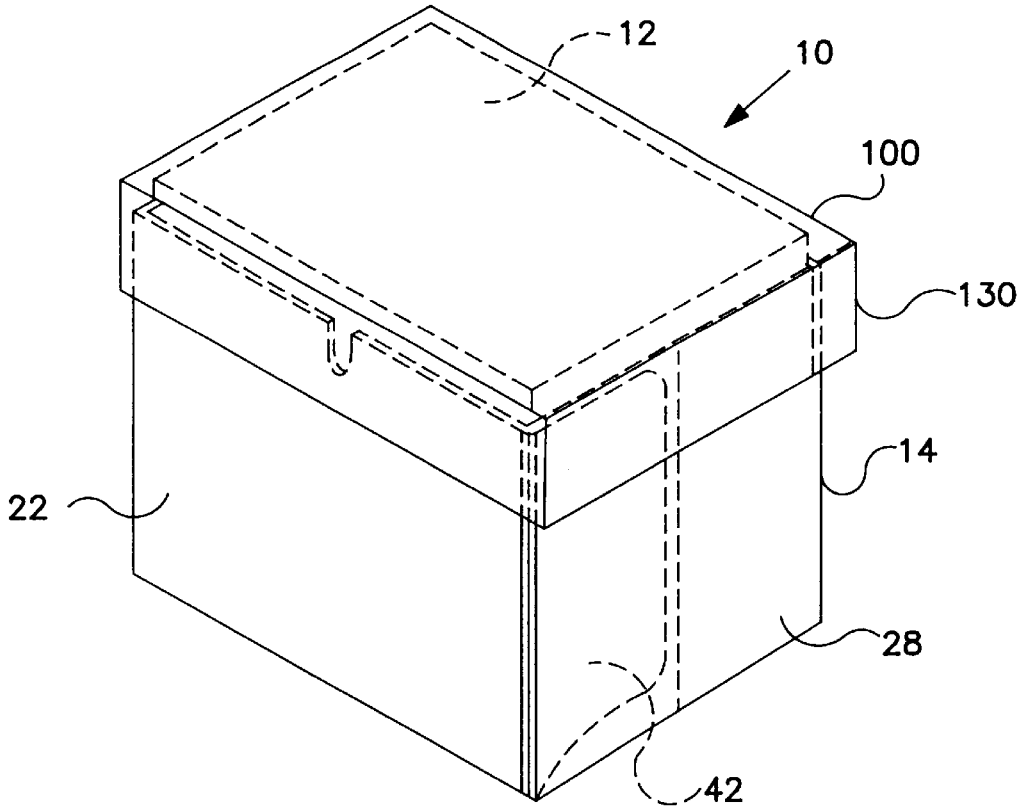
FIG. 1 is a perspective view of the new and improved container of the subject invention.
Figure 2:
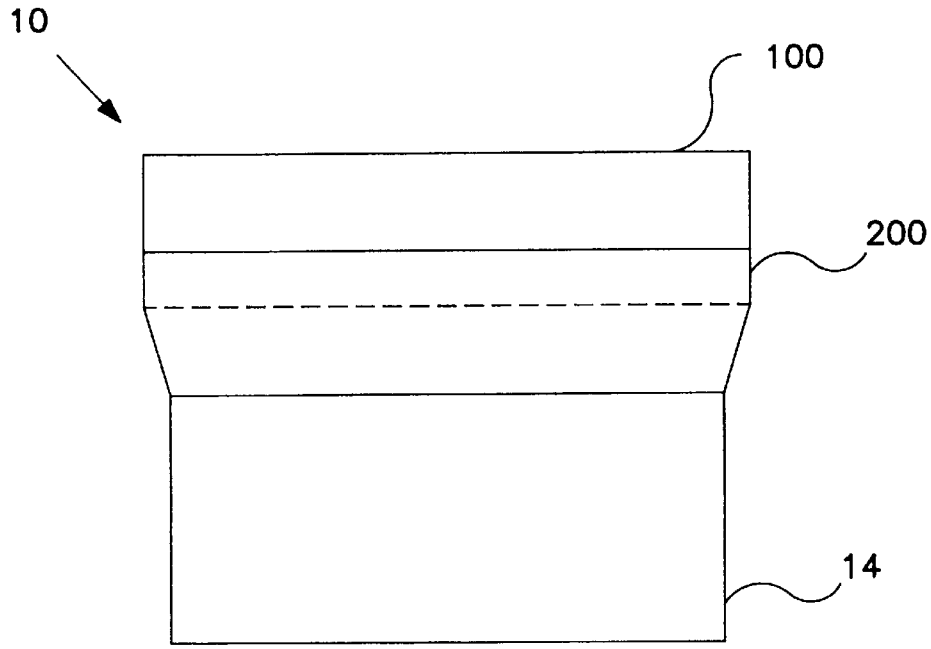
FIG. 2 is a side elevational view of the new and improved container of the subject invention as sealed with adhesive tape.

FIGS. 1–2 generally show a container 10 for packaging a stack of loose paper sheets 12. The container 10 comprises a carton 14 and a lid 100 for emplacement thereon. The lid 100 may be tightly secured to the carton 14 by an adhesive tape 200 which is disposed about and secures the lid 100 and the carton 14, as described below.

Figure 5:
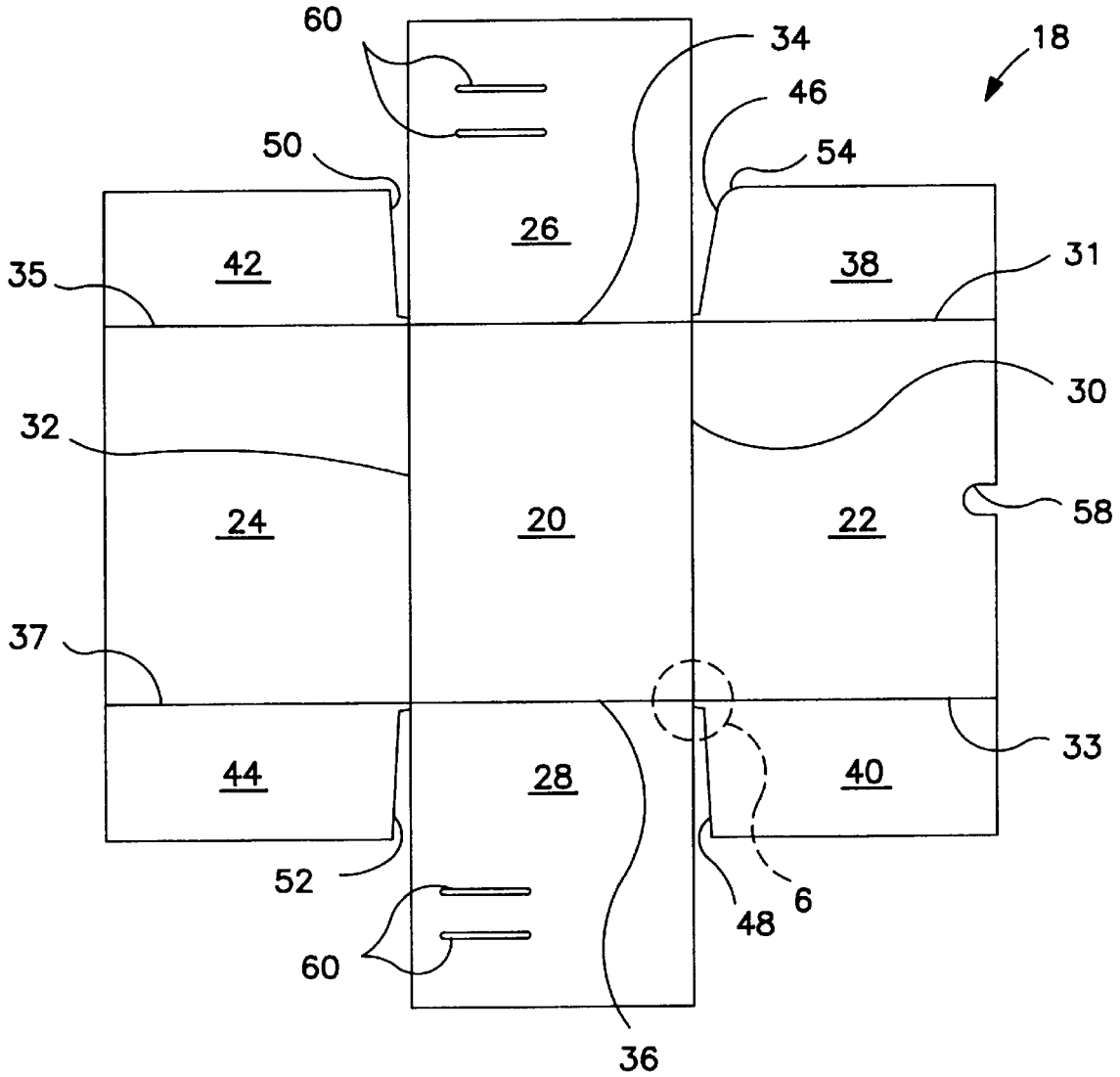
FIG. 5 is a plan view of the inner surface of the corrugated fibreboard blank which forms the carton of the new and improved container of the subject invention.

Specifically, the carton 14, as shown in FIGS. 1, 2, 3 and 5, is formed from a unitary, single-thickness corrugated fibreboard blank 18 having a bottom panel 20 to which two side panels 22, 24 and two end panels 26, 28 are foldably connected along scored, fold lines 30, 32 and 34, 36 respectively. The bottom 20 is dimensioned to substantially coincide with the dimensions of the paper sheets of the stack 12. Two substantially rectangular minor flaps 38, 40 and 42, 44 extend from the ends of each of the side panels 22 and 24 adjacent to the respective end panels 26 and 28 and are foldably connected to the side panels 22 and 24 along fold lines 31, 33 and 35, 37, respectively. The minor flaps 38, 40, 42, 44 are formed with inner edges 46, 48, 50, 52, respectively, which extend from a point adjacent the intersection of the respective minor flap 38, 40, 42, 44 and the respective side panel 22, 24 in an outwardly tapered direction. Accordingly, a clearance is created between the minor flaps 38, 42 and 40, 44 and the respective end panels 26 and 28, with limited points of engagement therebetween. The minor flap 38 may be provided with a rounded, inner comer 54 as shown in FIG. 5, to facilitate re-engagement of the minor flaps 38, 40.

Figure 6:
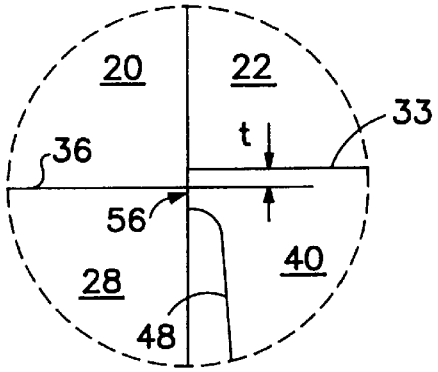
FIG. 6 is an enlarged sectional view of the section marked 6 in FIG. 5.

As more clearly shown in FIG. 6, the fold lines 34 and 36 are not colinear with the fold lines 31, 35 and 33, 37, respectively. The fold lines 31, 35 and 33, 37 are offset from the fold lines 34 and 36 a distance "t" which is substantially equal to the thickness of the corrugated fibreboard blank 18. Each minor flap 39, 40, 42, 44 is formed with a planar base edge portion 56 which extends from the respective fold lines 31, 33, 35, 37 to the respective inner edge 46, 48, 50, 52. The planar base edge portions 56 overlap the respective fold lines 34, 36, and are detached from the bottom panel 20 and the respective adjacent end panel 26, 28. The planar base edge portions 56 are in near face-to-face contact with the bottom panel 20 and the respective adjacent end panel 26, 28. As used herein, "near face-to-face contact" means actual abutting contact or being separated by a space no more than the width of a conventional cutting instrument used in the art. When assembled, as described below, the planar base edge portions 56 limit the introduction of moisture into the assembled container 10.

The preferred method of forming the carton 14 from the corrugated fibreboard blank 18 with the stack of loose paper sheets 12 being packaged therein will be described. Other processes may be used to form the carton 14 and/or package the stack of loose paper sheets 12 therein, such processes being derived from re-arranging the sequence of steps described with respect to the preferred process. The stack of loose paper sheets 12 is accumulated on the bottom panel 20. Preferably, the paper sheets are placed in one ream (approximately 500 sheets) units on the bottom panel 20 until the desired quantity of paper sheets is accumulated. As the stack of loose paper sheets 12 is being disposed on the bottom panel 20, the side panels 22, 24 are gradually folded upwardly along the fold lines 30, 32, respectively, into a substantially perpendicular relationship relative to the bottom panel 20. Preferably, the side panels 22, 24 are folded upwardly at a rate such that the side panels 22, 24 will reach the perpendicular positions relative to the bottom panel 20 substantially simultaneously with the stack of loose paper sheets 12 being fully accumulated on the bottom panel 20.

With the side panels 22, 24 being upright and perpendicular relative to the bottom panel 20 and the stack of loose paper sheets 12 being accumulated on the bottom panel 20, the minor flaps 38, 40, 42, 44 are folded inwardly along the fold lines 31, 33, 35, 37, respectively, to be substantially perpendicular to the respective side panel 22, 24 and with one surface being substantially in face-to-face engagement with a portion of the stack of loose paper sheets 12. Adhesive stripes 60 are provided on each of the end panels 26 and 28 in regions adjacent the side panel 24. The end panels 26 and 28 are folded upwardly along the fold lines 34 and 36, respectively, to be substantially perpendicular to the bottom panel 20 such that the surfaces of the end panels 26 and 28, on which the adhesive stripes 60 are disposed, are in face-to-face engagement with the minor flaps 38, 42 and 40, 44, respectively. In this manner, the adhesive stripes 60 are located between the flaps 42 and 44 and the end panels 26 and 28, respectively. The adhesive will cause the end panels 26 and 28 and the side panel 24 to be rigidly maintained in a substantially perpendicular relationship to the bottom panel 20.

Figure 3:
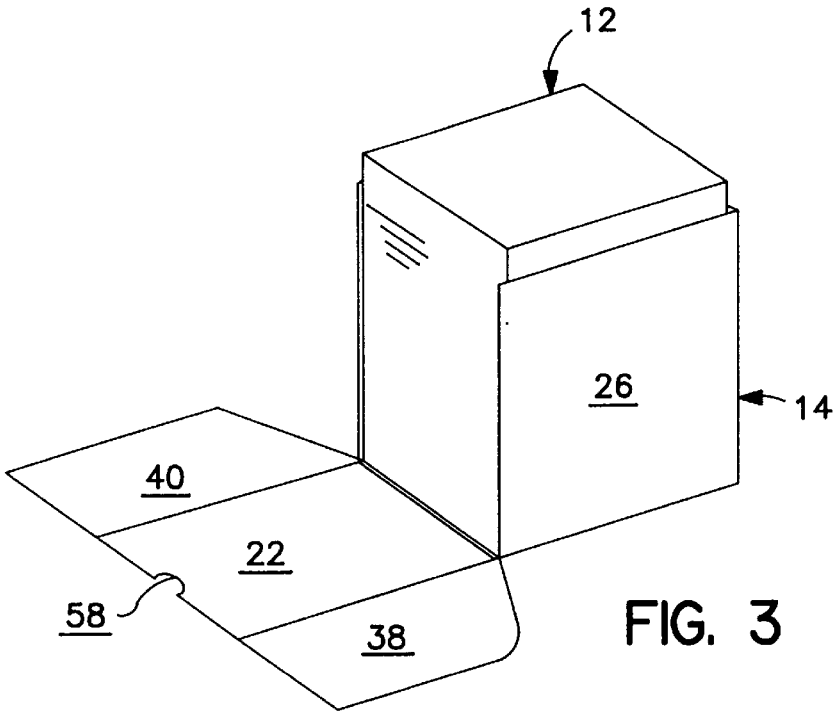
FIG. 3 is a perspective view of an opened carton of the new and improved container of the subject invention.

The regions of the end panels 26, 28 adjacent the side panel 22 are not provided with adhesive. The face-to-face engagement between the flaps 38 and 40 and the panels 26 and 28 create friction therebetween and maintain the side panel 22 in a substantially perpendicular relationship to the bottom panel 20. The friction between the flaps 38 and 40 and the end panels 26 and 28 may be overcome by applying a pulling force to the side panel 22 at a point spaced from the bottom panel 20. For easy control of the side panel 22, a notch 58 may be provided in an edge of the side panel 22 for engagement by an individual. With the side panel 22 being in an upright position, the side panels 22, 24 and the end panels 26, 28 define a substantially rectangular cross-section having dimensions substantial equivalent to the dimensions of the paper sheets of the stack 12. The side panels 22, 24 and the end panels 26, 28 define an open top side, opposite the bottom panel 20, with all the panels 22, 24 and 26, 28 being upright. The side panel 22 is formed to rotate about the fold line 30 from a non-upright position, as shown in FIG. 3, to a fully upright position, as shown in FIG. 1. To maintain the side panel 22 in an upright position, the flaps 38 and 40 are folded inwardly along the fold lines 31 and 33, respectively, and disposed with one surface thereof in face-to-face engagement with the respective adjacent end panel 26 and 28. Access may be provided to the stack 12 by rotating downwardly the side panel 22 into a non-upright position. Accordingly, as shown in FIG. 3, one full side of the stack 12 is made fully accessible.

Additionally, with the carton 14 being fully assembled, the planar base edge portions 56 of the minor flaps 38, 40, 42, 44 limit the ingress of moisture into the carton 14. The offset "t" between the respective fold lines 26 and 38, 42; 28 and 40, 44 allows the respective minor flaps 38, 40, 42, 44 to be folded relative to the respective side panel 22, 24 and be disposed adjacent the respective end panels 26, 28 in a substantially perpendicular relationship to the respective side panels 22, 24. With the side panels 22, 24 being fully upright and the minor flaps 38, 40, 42, 44 being folded inwardly, the planar base edge portions 56 are in face-to-face engagement with portions of the bottom panel 20. The respective face-to-face engagements of the planar base edge portions 56 and the bottom panel 20 limits the amount of moisture which may enter through the four lower comers of the carton 14.

Figure 4:
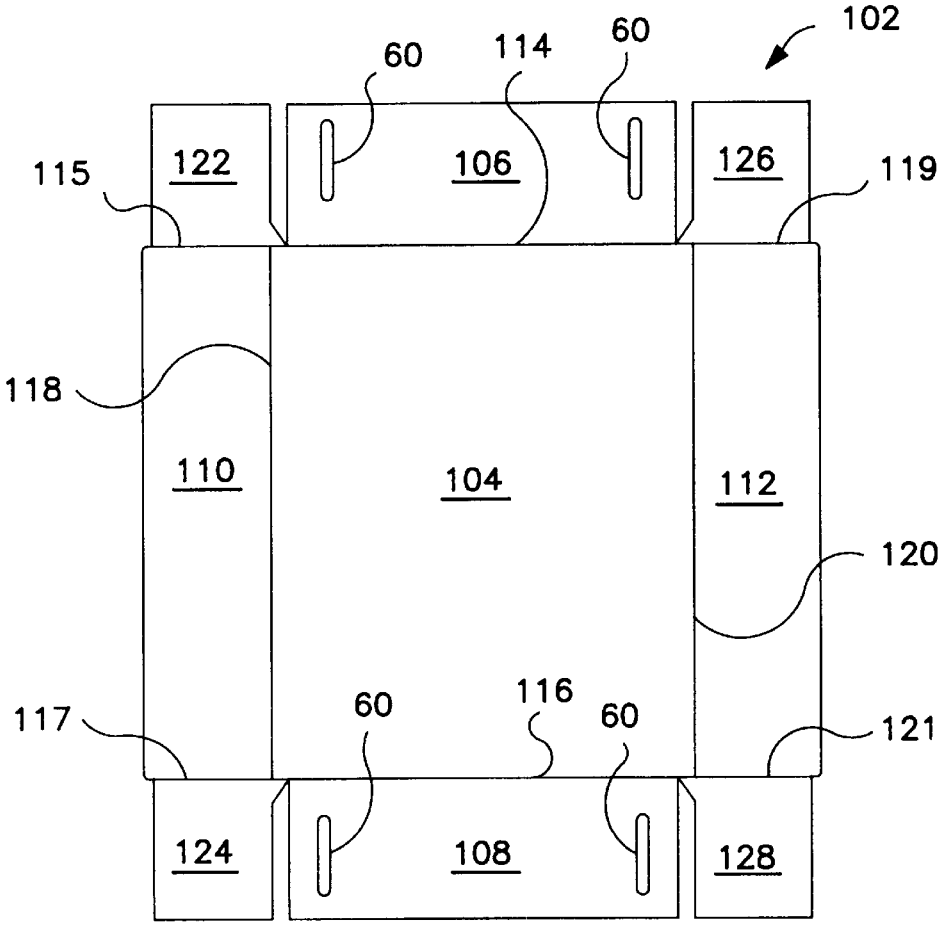
FIG. 4 is a plan view of the inner surface of the corrugated fibreboard blank used to form the lid of the new and improved container of the subject invention.

As shown in FIGS. 1, 2 and 4 generally, the lid 100, in the preferred embodiment, is formed from a corrugated fibreboard blank 102 including a rectangular base portion 104 to which two opposing end walls 106, 108 and opposing side walls 110, 112 are foldably connected through score lines 114, 116 and 118, 120 respectively. The base portion 104 is formed to define dimensions slightly greater than the dimensions of the bottom 20 of the carton 14 to allow emplacement of the lid 100 on the carton 14, as described below. End flaps 122, 124 and 126, 128 extend from each of the ends of the side walls 110 and 112 in spaced relationship to the end walls 106 and 108 along score lines 115, 117 and 119, 121, respectively.

To assemble the lid 100 from the corrugated fibreboard blank 102, adhesive stripes 60 are provided at opposing regions on one surface of each of the end panels 106 and 108 adjacent the respective end flaps 122, 126 and 124, 128. The side walls 110, 112 and the end walls 106, 108 are folded along the fold lines 114, 116 and 118, 120, respectively. One face of each of the end flaps 122, 124, 126, 128 is disposed to be in face-to-face engagement with the respective adjacent end wall 106 and 108 with the adhesive stripes 60 being located between the end flaps 122, 126 and 124, 128 and the end walls 106 and 108, respectively. The adhesive will maintain the end walls 106, 108 and the side walls 110, 112 in a substantially perpendicular relationship to the base portion 104. The end walls 106, 108 and the side walls 110, 112 collectively define a downwardly depending peripheral edge 130 having inner dimensions formed to register with the top of the carton 14. With the lid 100 emplaced on the carton 14, as can be seen from FIG. 1, the edge 130 overlaps a portion of the side panel 22 and provides additional support for maintaining the side panel 22 in an upright position.

When transporting the container 10, it is desirable to restrict the amount of moisture to which the stack of loose paper sheets 12 is exposed. To this end, the lid 100 is tightly secured to the carton 14 by the adhesive tape 200, as shown in FIG. 2. The tape 200 is disposed about the carton 14 and the lid 100 so as to simultaneously engage portions of both the carton 14 and the lid 100. Additionally, the inner surfaces of the container 10 may be coated with a moisture resistant coating. The inner surface of the corrugated fibreboard blank 18 is shown in FIG. 5, including the bottom 20, the side panels 22, 24, the end panels 26, 28 and the flaps 38, 40, 42, 44, may be entirely coated with a moisture resistant coating. With respect to the lid 100, the inner surface of the corrugated fibreboard blank 102, shown in FIG. 4, may be entirely coated with a moisture resistant coating. The combination of the tight securement created by the adhesive tape 200 and the moisture resistant coating disposed on the inner surfaces of the carton 14 and the lid 100 limit the amount of moisture to which the stack of loose paper sheets 12 stored in the container 10 is exposed. As an alternative, the blanks may be formed from a laminated liner, rather than a coated liner. Liner sold under the tradename "FIBER-LAM POLY-CORR" by Fiber-Lam, Inc. is preferred.

Figure 7:
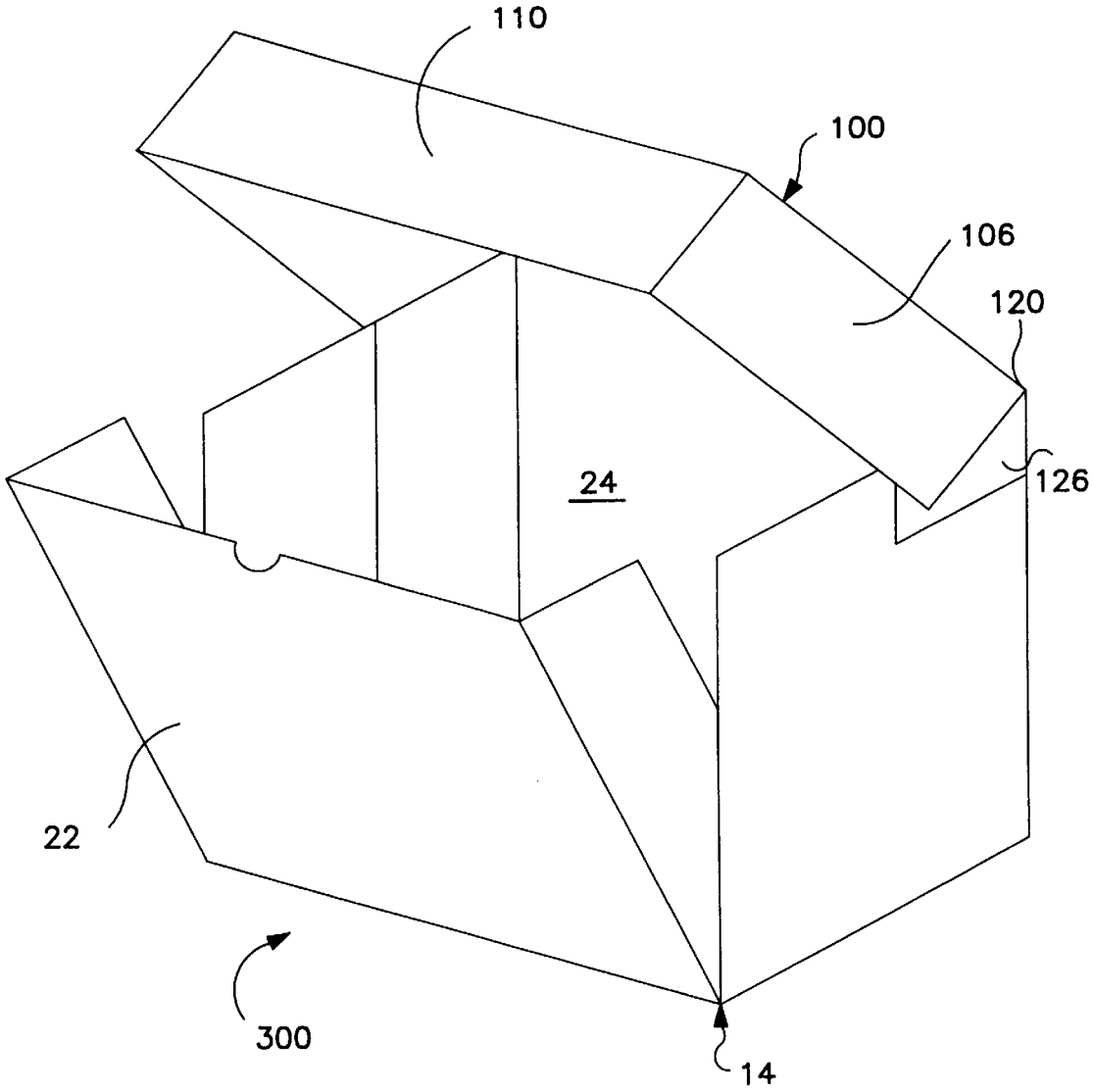
FIG. 7 is a perspective view of a second embodiment of the invention with the lid being hingedly secured to the carton.

In a second embodiment, a container 300 is provided comprising the carton 14 and the lid 100 described above. In the second embodiment, the lid 100 is hingedly secured to the carton 14, as shown in FIG. 7. Preferably, the inner surfaces of the end flap 126, 128 (not shown) and the side wall 112 (not shown) are secured to outer surfaces of the carton 14 with adhesive, including to the outer surface of the side panel 24. In forming the lid 100 for the container 300, the lid 100 must be slightly modified from the description set forth above. Specifically, no adhesive 60 is disposed on the end walls 106 and 108 adjacent the end flaps 126 and 128. The fold line 120 acts as a rotatable connection between the base portion 104 and the side wall 112. The fold line 120 is defined adjacent to the side wall 112, to form an edge thereof. The side panel 24 is planar and defines a plane which is interposed between the side wall 112, having the fold line 120 therealong, and the open top of the carton 14. This arrangement advantageously allows for maximum open area being defined at the open top of the carton 14, without obstruction from any portion of the lid 110. As such, paper sheets can be easily removed from the carton 14 without hindrance. In all other respects, the lid 100 is formed as set forth above. With this arrangement, the lid 100 can be rotated about the fold line 120 to expose the side panel 22 with the end walls 106 and 108 coming in and out of sliding overlapping contact with the end flaps 126 and 128. It is preferred that the lid 100 be rigidly secured to the carton 14 opposite the hinged side of the carton 14 so that the lid 100 rotates about an axis which is parallel to the axis about which the hinged side panel 22 rotates. As an additional feature, the side wall 110 may be secured to the hinged side panel 22 with a light glue bead which can be easily released by lifting the side wall 110 and/or sliding fingers underneath the sidewall 110.

Figure 8:
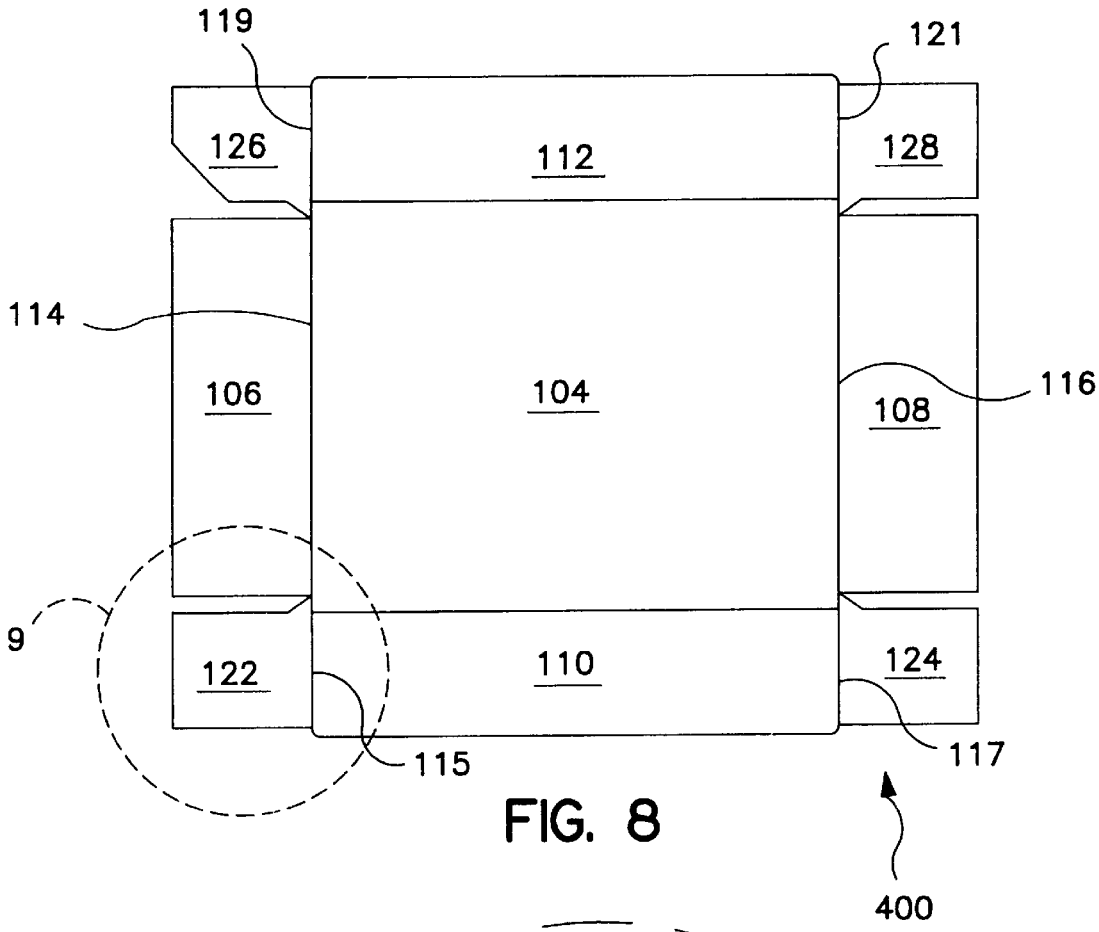
FIG. 8 is a plan view of an alternative embodiment of the corrugated fibreboard blank used to form the lid of the new and improved container of the subject invention.
Figure 9:
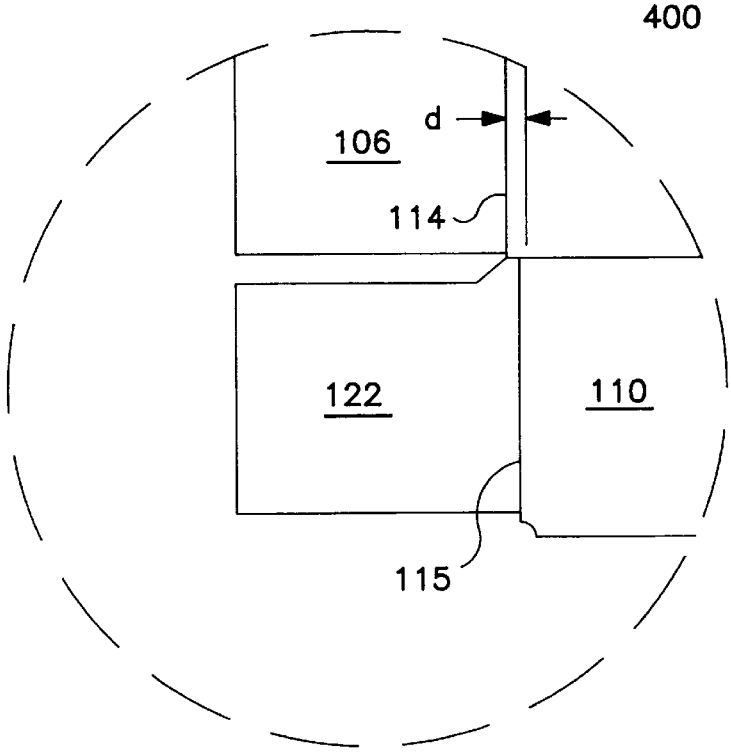
FIG. 9 is an enlarged sectional view of the section marked 9 in FIG. 8.

FIG. 8 shows a modified blank 400 for forming the lid 100. The blank 400 includes the same elements described above with respect to the blank 102 but is also formed to include a feature of the blank 18 used for forming the carton 14. As more clearly shown in FIG. 9, the fold lines 115, 119 and 117, 121, respectively, can be offset from the fold lines 114 and 116 by a distance "d". The distance "d" is preferably substantially equal to the thickness of the blank 400. The blank 400 can be used to form the lid 100 for either of the above-described embodiments, to wit, either for emplacement or for hinged connection to the carton 300.

As is readily apparent, numerous modifications and changes may readily occur to those skilled in the art, and hence it is not desired to limit the invention to the exact construction and operation shown and described and, accordingly, all suitable modification equivalents may be resorted to falling within the scope of the invention as claimed.

What is claimed is:

1. A container for packaging a plurality of paper sheets, said container comprising:

a corrugated fibreboard carton having a bottom, with a first side, a second side, a third side and a fourth side extending from said bottom to define an open top, said first side being hingedly connected to said bottom, said second, third, and fourth sides being rigidly connected to said bottom, said first side being provided with releasable engagement means for selectively maintaining said first side in an upright position substantially perpendicular to said bottom, wherein said second side being opposite said first side, and wherein said second side defining a plane; and a lid having a base and side walls extending from said base, one said side wall being rotatably connected to said base by a rotatable connection, wherein said rotatably connected side wall is rigidly secured to at least said second side of said carton with said plane being interposed between said open top and said rotatable connection, and wherein said base of said lid is rotatable relative to said carton about said rotatable connection.

2. A container as in claim 1, wherein said base of said lid rotates about a first axis, said first side of said carton rotates about a second axis, said first axis being parallel to said second axis.

3. A container as in claim 1, wherein portions of said lid are disposed to slidably overlap portions of said third and fourth sides.

4. A container as in claim 1, wherein said rotatably connected side wall is rigidly secured to said second side adjacent said open top.

5. A container as in claim 1, wherein said lid is releasably secured to said first side of said carton.

6. A container as in claim 1, wherein said carton and said lid are formed from laminated liners.

7. A combination comprising:

a plurality of paper sheets, said paper sheets each being formed with substantially the same dimensions; and a container for packaging the paper sheets, said container including:

a corrugated fibreboard carton having a bottom, with a first side, a second side, a third side and a fourth side extending from said bottom to define an open top, said first side being hingedly connected to said bottom, said second, third, and fourth sides being rigidly connected to said bottom, said first side being provided with releasable engagement means for selectively maintaining said first side in an upright position substantially perpendicular to said bottom, wherein said second side being opposite said first side, and wherein said second side defining a plane; and a lid having a base and side walls extending from said base, one said side wall being rotatably connected to said base by a rotatable connection, wherein said rotatably connected side wall is rigidly secured to at least said second side of said carton with said plane being interposed between said open top and said rotatable connection, wherein said base of said lid is rotatable relative to said carton about said rotatable connection, and wherein said plurality of sheets is disposed on said bottom between said first, second, third, and fourth sides.

8. A combination as in claim 7, wherein said base of said lid rotates about a first axis, said first side of said carton rotates about a second axis, said first axis being parallel to said second axis.

9. A combination as in claim 7, wherein portions of said lid are disposed to slidably overlap portions of said third and fourth sides.

10. A combination as in claim 7, wherein said rotatably connected side wall is rigidly secured to said second side adjacent said open top.

11. A combination as in claim 7, wherein said lid is releasably secured to said first side of said carton.

12. A combination as in claim 7, wherein said carton and said lid are formed from laminated liners.

* * * * *